US009259137B2

(12) United States Patent
Boyer et al.

(10) Patent No.: US 9,259,137 B2
(45) Date of Patent: Feb. 16, 2016

(54) MID-LEVEL SPRAY ARM ASSEMBLY FOR DISHWASHER APPLIANCES

(71) Applicant: General Electric Company, Schenectady, NY (US)

(72) Inventors: Joel Charles Boyer, Louisville, KY (US); Kyle Edward Durham, Louisville, KY (US); Daniel Jason Bentley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 76 days.

(21) Appl. No.: 14/073,186

(22) Filed: Nov. 6, 2013

(65) Prior Publication Data

US 2015/0122298 A1 May 7, 2015

(51) Int. Cl.
*A47L 15/23* (2006.01)
*A47L 15/42* (2006.01)

(52) U.S. Cl.
CPC ..... *A47L 15/23* (2013.01); *A47L 15/4221* (2013.01); *A47L 15/4282* (2013.01)

(58) Field of Classification Search
None
See application file for complete search history.

(56) References Cited

U.S. PATENT DOCUMENTS 5,899,433 A 5/1999 Kim et al.
6,705,330 B1 3/2004 Favret
7,100,623 B2 9/2006 Assmann et al.
7,237,563 B2 7/2007 Han et al.
7,337,790 B2 3/2008 Ha
7,614,408 B2 * 11/2009 Park et al. ..... 134/56 D
7,896,977 B2 3/2011 Gillum et al.
2004/0103926 A1 6/2004 Ha
2006/0054198 A1 3/2006 Choi
2007/0119488 A1 5/2007 Kwan
2009/0139553 A1 6/2009 Park
2010/0043825 A1 * 2/2010 Bertsch et al. ..... 134/18
2012/0266924 A1 10/2012 Boyer et al.
2012/0318389 A1 * 12/2012 Holstein et al. ..... 137/625
2013/0000762 A1 1/2013 Buddharaju et al.

* cited by examiner

*Primary Examiner* — Michael Barr
*Assistant Examiner* — Cristi Tate-Sims
(74) *Attorney, Agent, or Firm* — Dority & Manning, P.A.

(57) ABSTRACT

A dishwasher appliance includes a mid-level spray arm assembly and a diverter disposed in a conduit of the assembly. The diverter includes a disk positioned within a chamber and rotatable about an axis, the disk defining an aperture for selectively controlling fluid flow from the chamber into outlet channels, the disk movable along the axial direction between a first position and a second position, the disk defining a channel and a plurality of cams projecting into the channel. The diverter further includes a biasing element configured to urge the disk into the first position, and a boss extending from the housing into the channel of the disk, the boss defining a plurality of guide elements. The guide elements and cams are configured to interact so that movement of the disk along the axial direction between the first position and the second position causes the disk to rotate about the axis.

20 Claims, 7 Drawing Sheets

MID-LEVEL SPRAY ARM ASSEMBLY FOR DISHWASHER APPLIANCES

FIELD OF THE INVENTION

The subject matter of the present disclosure relates generally to dishwasher appliances, and more particularly to mid-level spray arm assemblies in dishwasher assemblies which include passive indexing diverters

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

A dishwashing appliance is typically equipped with at least one pump for circulating fluid through the spray assemblies. However, due to e.g., government regulations related to energy and/or water usage, the pump may not be able to supply fluid to all spray assemblies at the same time. Further, mid-level spray assemblies may include various outlets through which fluid may be directed. In many cases, it may not be desirable or feasible to supply fluid to all outlets of a spray assembly at the same time. Accordingly, a dishwashing appliance that can be configured to selectively control the flow through different outlets of mid-level spray assemblies would be useful.

Certain conventional dishwashing appliances use a device, referred to as a diverter, to control the flow of fluid in the dishwashing appliance. For example, the diverter can be used to selectively control which flow assemblies receive a flow of fluid. In one construction, the diverter uses an electrically powered motor to rotate an element between different ports for fluid control. The motor adds a significant expense to the overall manufacturing cost of the dishwashing appliance and must be separately controlled during cleaning operations so that the proper flow is occurring.

Additionally, the motor is typically positioned below the diverter, which is positioned below the sump portion of the appliance. As such, significant space is consumed which can reduce the space available in the dishwashing compartment for placement of dishes, glasses, silverware, and other items for cleaning Thus, a diverter that does not require an electrically powered motor to operate would be beneficial, resulting in a savings in both costs and space.

BRIEF DESCRIPTION OF THE INVENTION

The present invention provides a mid-level spray arm assembly having a passive diverter, i.e.—a diverter that does not require a dedicated motor to switch between multiple outlet ports. The diverter uses the forces provided by a flow of fluid within the mid-level spray arm assembly to switch between different outlet ports. In a dishwashing appliance, fluid can thus be used to cause the diverter to switch between different fluid outlets and the different components of the mid-level spray arm assembly. A separate motor to power the diverter is not required, which allows a savings in costs and space. Additional aspects and advantages of the invention will be set forth in part in the following description, may be apparent from the description, or may be learned through practice of the invention.

In one exemplary embodiment, the present disclosure provides a dishwasher appliance. The dishwasher appliance includes a tub that defines a wash chamber for receipt of articles for washing, and a mid-level spray arm assembly for directing a fluid flow into the wash chamber. The mid-level spray arm assembly includes a spray arm and a conduit in fluid communication with the spray arm, the conduit defining a plurality of outlet channels for providing the fluid flow to the wash chamber. The dishwasher appliance further includes a diverter disposed in the conduit and defining an axial direction. The diverter includes a housing defining a chamber, the chamber having a fluid inlet and at least one outlet port to supply fluid to the outlet channels. The diverter further includes a disk positioned within the chamber and rotatable about an axis, the disk defining an aperture for selectively controlling fluid flow from the chamber into one of the outlet channels, the disk movable along the axial direction between a first position and a second position, the disk defining a channel and a plurality of cams projecting into the channel. The diverter further includes a biasing element configured to urge the disk into the first position, and a boss extending from the housing into the channel of the disk, the boss defining a plurality of guide elements. The guide elements and cams are configured to interact so that movement of the disk along the axial direction between the first position and the second position causes the disk to rotate about the axis.

In another exemplary embodiment, the present invention provides a mid-level spray arm assembly for a dishwasher appliance. The assembly includes a spray arm, a conduit in fluid communication with the spray arm, the conduit defining a plurality of outlet channels, and a diverter disposed in the conduit and defining an axial direction. The diverter includes a housing defining a chamber, the chamber having a fluid inlet and at least one outlet port to supply fluid to the outlet channels. The diverter further includes a disk positioned within the chamber and rotatable about an axis, the disk defining an aperture for selectively controlling fluid flow from the chamber into one of the outlet channels, the disk movable along the axial direction between a first position and a second position, the disk defining a channel and a plurality of cams projecting into the channel. The diverter further includes a biasing element configured to urge the disk into the first position, and a boss extending from the housing into the channel of the disk, the boss defining a plurality of guide elements. The guide elements and cams are configured to interact so that movement of the disk along the axial direction between the first position and the second position causes the disk to rotate about the axis These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
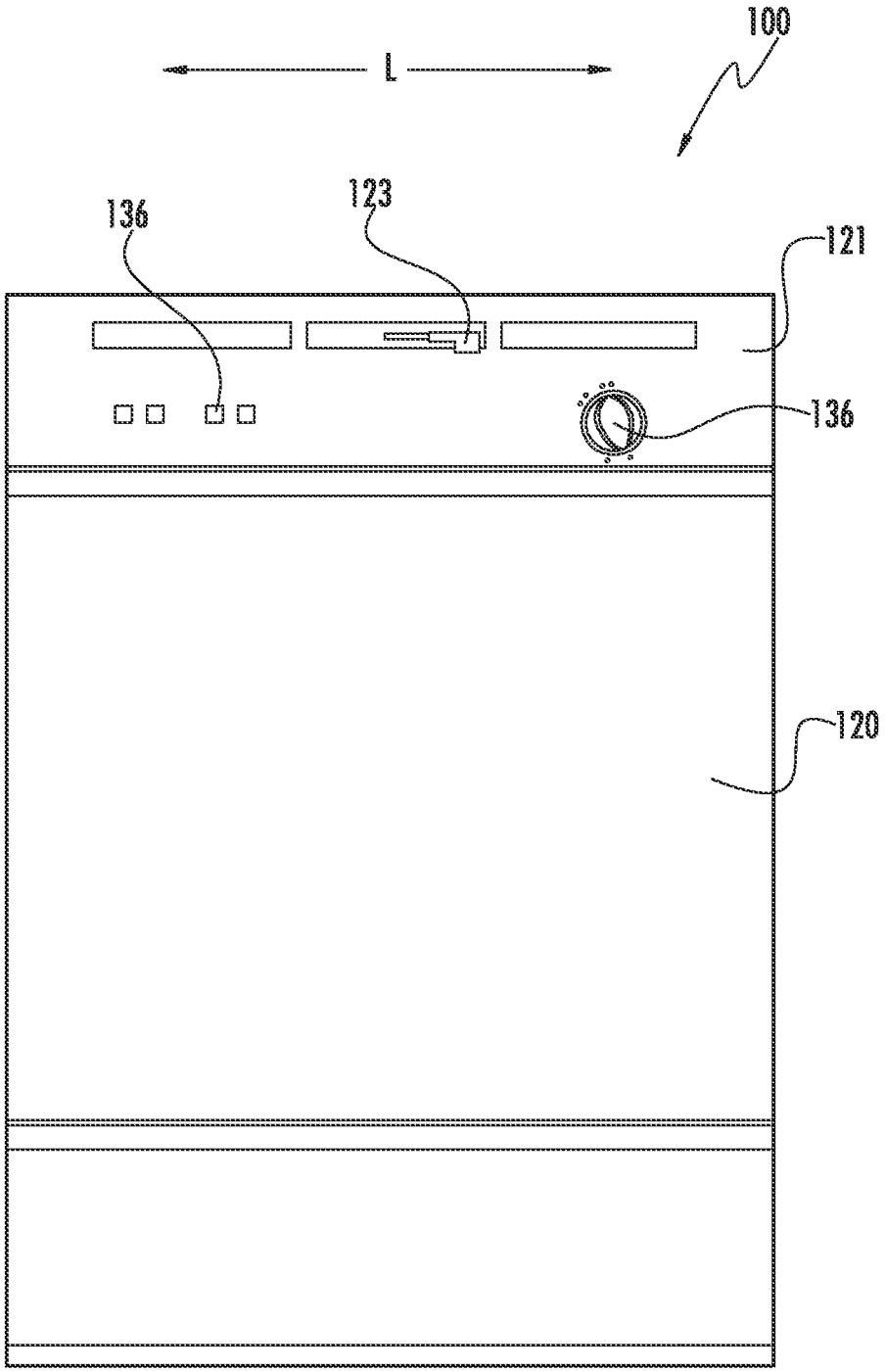
FIG. 1 provides a front view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
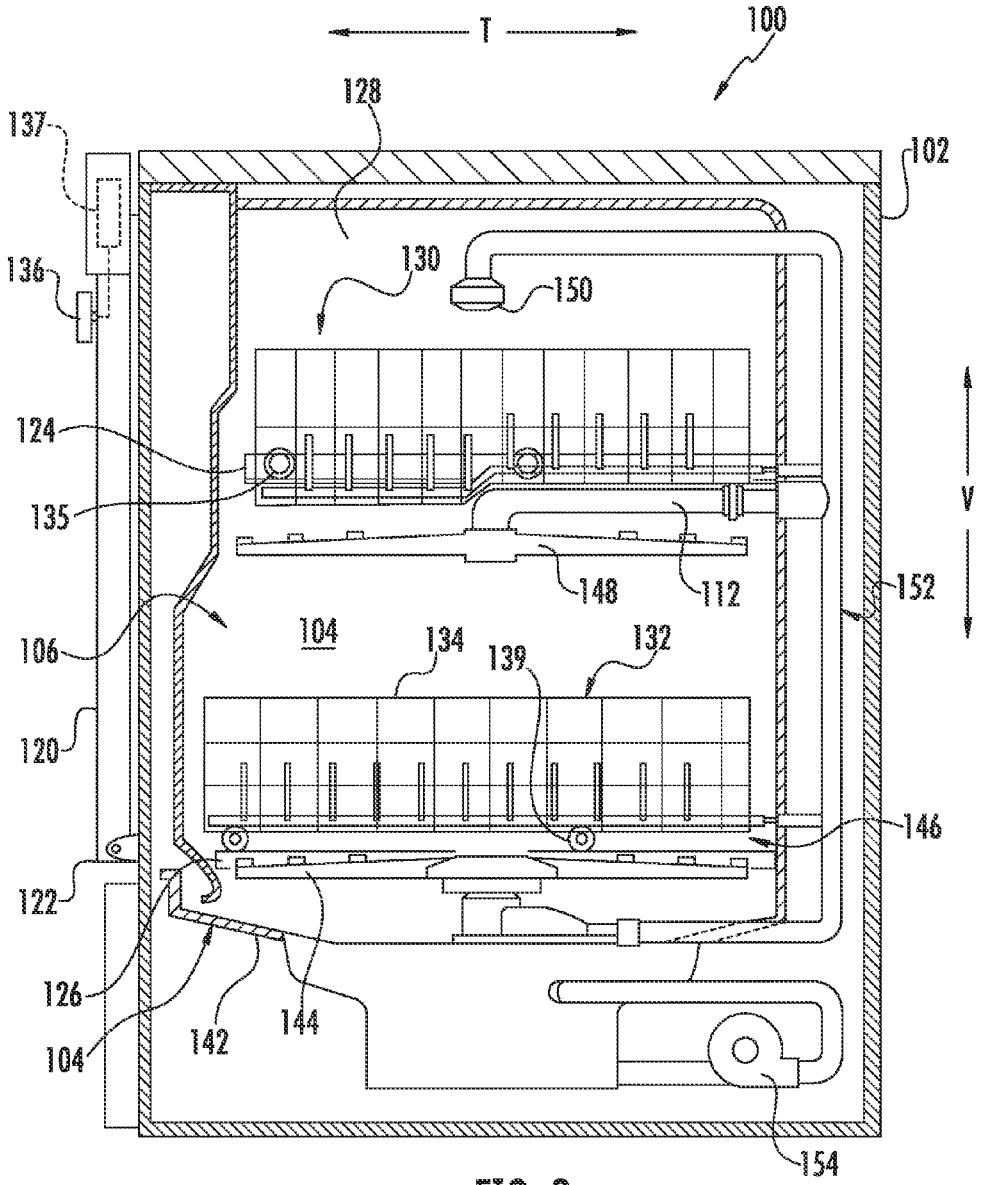
FIG. 2 provides a side, cross-sectional view of the exemplary dishwashing appliance of FIG. 1.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are part of a fluid circulation assembly 152 for circulating water and dishwasher fluid in the tub 104. The fluid circulation assembly 152 also includes a pump 154 positioned in a machinery compartment 140 located below the tub sump portion 142 (i.e., bottom wall) of the tub 104, as generally recognized in the art. Pump 154 receives fluid from sump 142 and provides a flow to the various assemblies 144, 148, 150.

Each spray-arm assembly 144, 148 includes an arrangement of discharge ports or orifices for directing washing liquid received from diverter 200 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 provides coverage of dishes and other dishwasher contents with a washing spray. Other configurations of spray assemblies may be used as well.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

Figure 3:
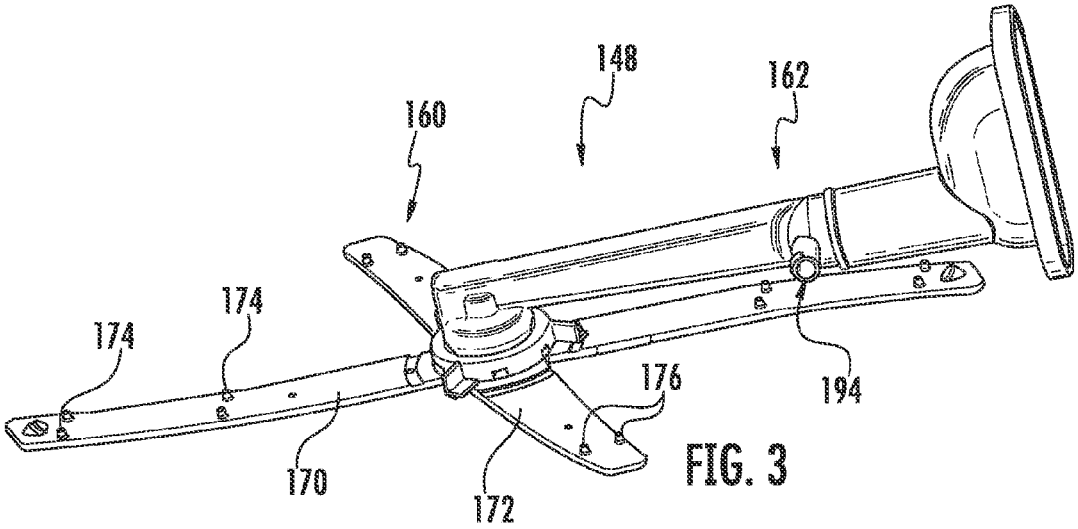
FIG. 3 is a perspective view of an exemplary embodiment of mid-level spray arm assembly of the present disclosure.
Figure 4:
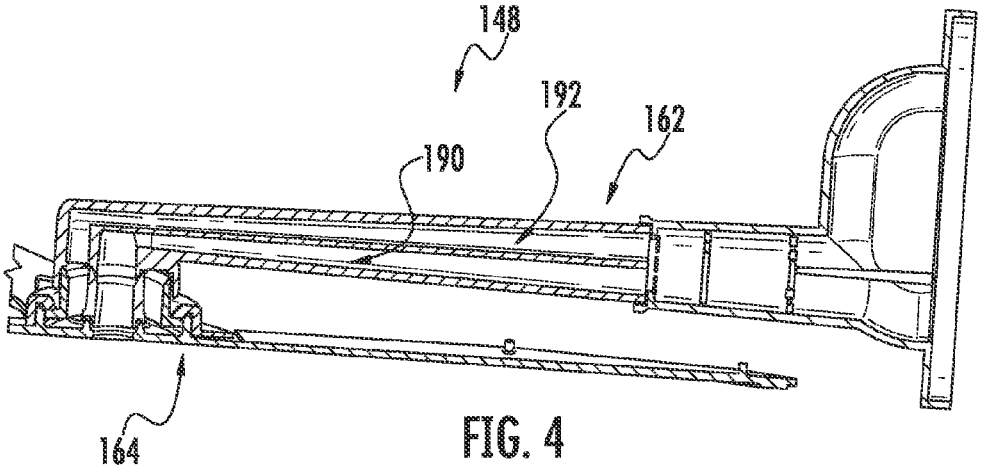
FIG. 4 is a side cross-sectional view of an exemplary embodiment of mid-level spray arm assembly of the present disclosure.
Figure 5:
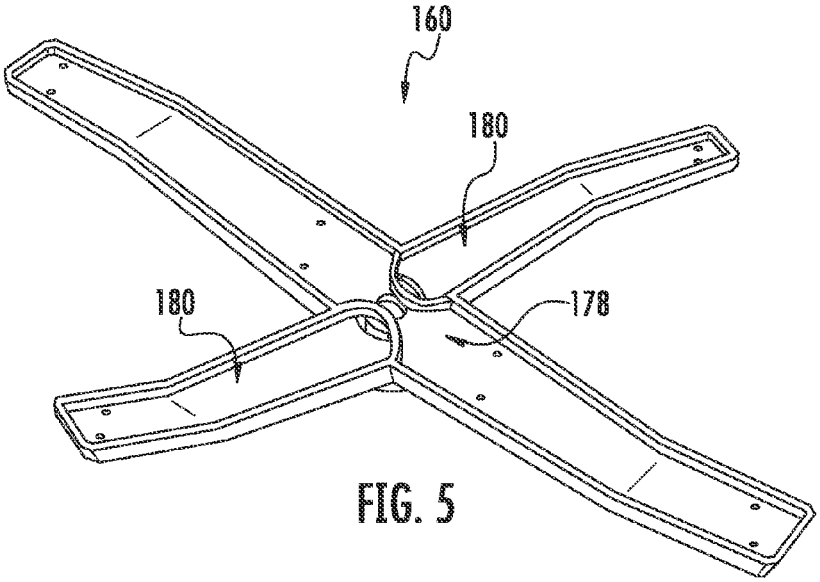
FIG. 5 is a cross-sectional view of various internal components of an exemplary embodiment of mid-level spray arm assembly of the present disclosure.

FIGS. 3 through 5 illustrate a mid-level spray arm assembly 148 in accordance with various embodiments of the present disclosure. As discussed, the assembly 148 is operable to direct a fluid flow into the wash chamber 106, for example via a spray arm 160 and a conduit 162. Conduit 162 may be in fluid communication with the spray arm 160, and may thus supply the fluid flow to the spray arm 160. Fluid may be received from the fluid circulation assembly 152 by the conduit 162 for flowing to the spray arm 160.

As shown, spray arm 160 may include a primary arm 170 and a reverse arm 172. Each arm 172 may include a plurality of discharge ports 174, 176, respectively, and may further include channels 178, 180 defined in the arm 170, 172 for flowing fluid to the ports 174, 176. As discussed herein, fluid may be selectively flowed to either channels 178, 180 for flowing to the ports 174, 176, and from the portion 174, 176 into the wash chamber 106.

A plurality of outlet channels may be defined in conduit 162. Various of the channels may, for example, be in fluid communication with the spray arm 160, such as with the channels 178, 180 thereof, for flowing fluid to the spray arm 160. The outlet channels may thus provide the fluid flow to the wash chamber 106. As shown, for example, conduit 162 may include a primary channel 190 and a reverse channel 192. Primary channel 190 may be in fluid communication with the primary arm 170 and channel 178 thereof, while reverse channel 192 may be in fluid communication with the reverse arm 172 and channel 180 thereof. Conduit 162 may additionally include a bottle blaster channel 194 (see FIGS. 3 and 6). Bottle blaster channel 194 may exhaust fluid directly therefrom into the wash chamber 106, rather than flowing fluid to the spray arm 160. As discussed herein, fluid may be selectively flowed to the channels 190, 192, 194 for further flow into the wash chamber 106.

Referring now to FIGS. 6 through 11, various embodiments of a passive diverter 200 for use with a mid-level spray arm assembly 148 are illustrated. Diverter 200 is disposed in conduit 162, such as upstream of the conduit 162 outlet channels in the fluid flow direction. Advantageously, diverter 200 selectively controls the fluid flow into the various outlet channels, without the need for an additional motor or other active component.

Diverter 200 may include, for example, a housing 202 defining a chamber 204. The chamber 204 defines a fluid inlet 206 to the diverter 200 and at least one fluid outlet port to supply the flow of fluid to respective outlet channels 190, 192, 194. For example, in exemplary embodiments, a plurality of fluid outlet ports 210, 212, 214 may be provided, each of which is in fluid communication with a respective outlet channel 190, 192, 194. In exemplary embodiments, the housing 202 is a portion of the conduit 162 that is upstream of the outlet channels 190, 192, 194, such that the fluid flow from the fluid circulation assembly 152 is directed into the housing 202 in the conduit 162 through inlet 206, through the housing 202, and from the housing 202 through outlets 210, 212, 214 selectively into outlet channels 190, 192, 194.

Diverter 200 further includes a disk 220 which is positioned in the chamber 204 and rotatable about an axis 222, such as a central axial axis which may extend longitudinally through chamber 204. The disk defines an aperture 224 for selectively controlling fluid flow from the chamber 204 into one of the outlet channels 190, 192, 194 through one of the outlet ports 210, 212, 214. Disk 220 can, for example, be selectively rotated such that aperture 224 aligns with one of the outlet ports 210, 212, 214 and fluid can be flowed through this port.

Such selective switching of the aperture 224 may advantageously occur without use of a motor or other active component. For example, as can be seen by comparing FIGS. 7 through 9, disk 220 is movable along an axial direction 226 (or along axis 222, which is parallel to the axial direction 226) between a first position shown in FIG. 7 and a second position shown in FIG. 9. In the first position shown in FIG. 7, disk 220 is spaced from ports 210, 212, 214, and cams (discussed herein) of the disk 220 are not in contact with guide elements of a boss (discussed herein) that the disk 220 may interact with to facilitate rotation thereof. In the second position shown in FIG. 9, disk 220 may be proximate or in contact with ports 210, 212, 214, and the cams may be in contact with the guide elements. FIG. 8 illustrates the disk 220 between the first position and the second position.

Figure 7:
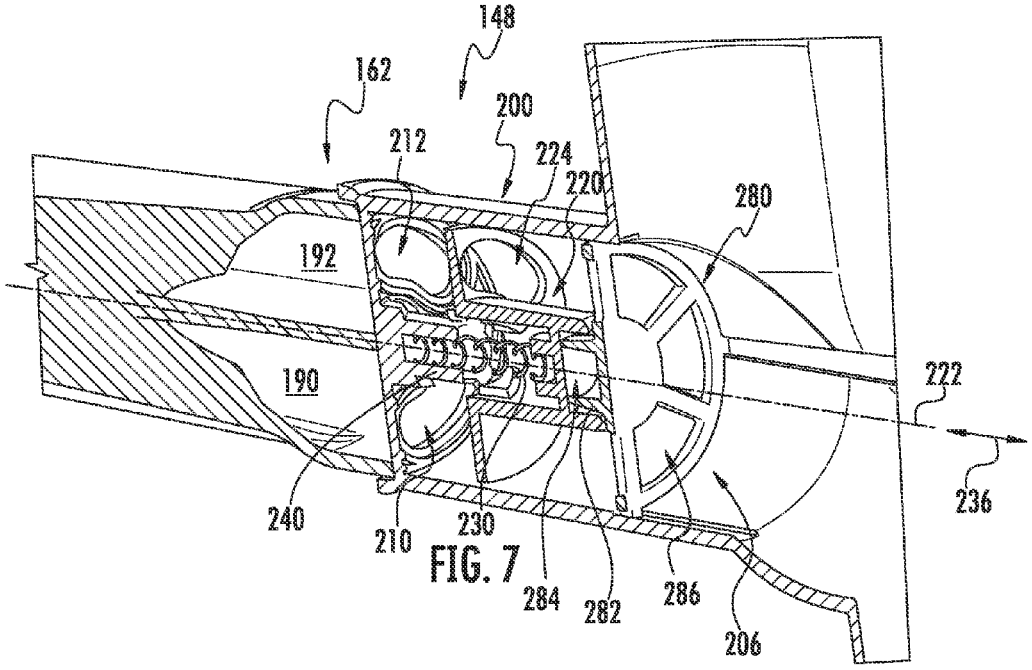
FIG. 7 is a cross-sectional view of an exemplary passive diverter in a conduit of an exemplary embodiment of mid-level spray arm assembly of the present disclosure with an internal disk shown in a first position.
Figure 8:
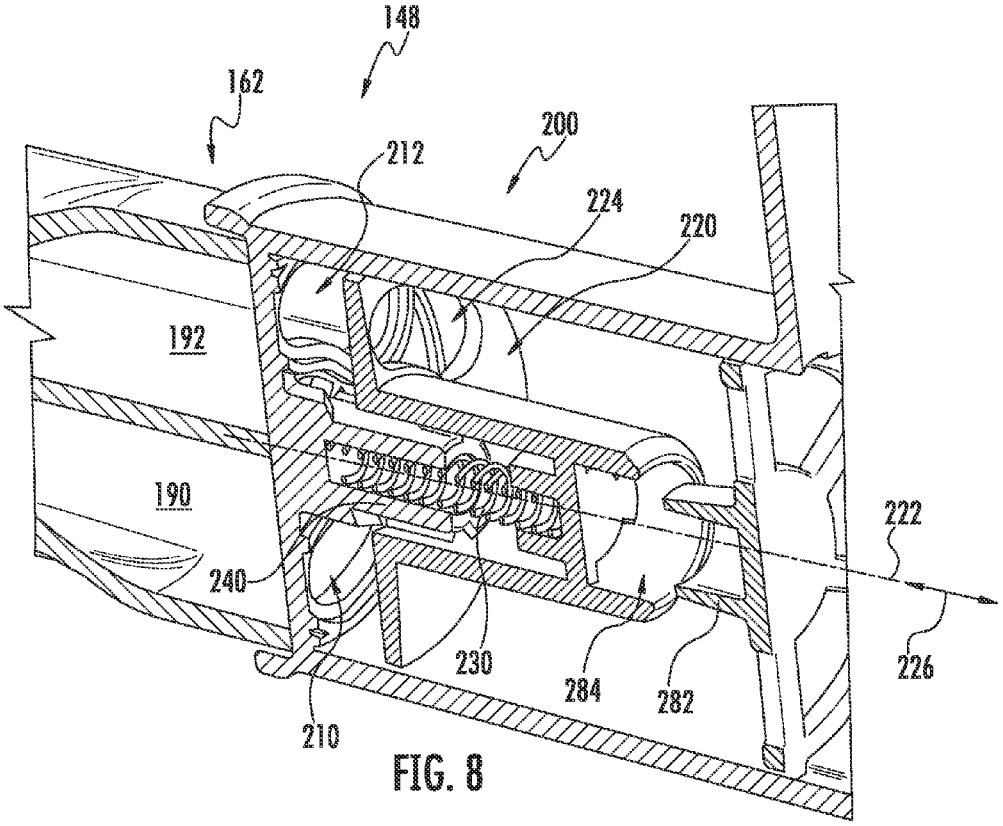
FIG. 8 is a cross-sectional view of an exemplary passive diverter in a conduit of an exemplary embodiment of mid-level spray arm assembly of the present disclosure with an internal disk shown between a first position and a second position.
Figure 9:
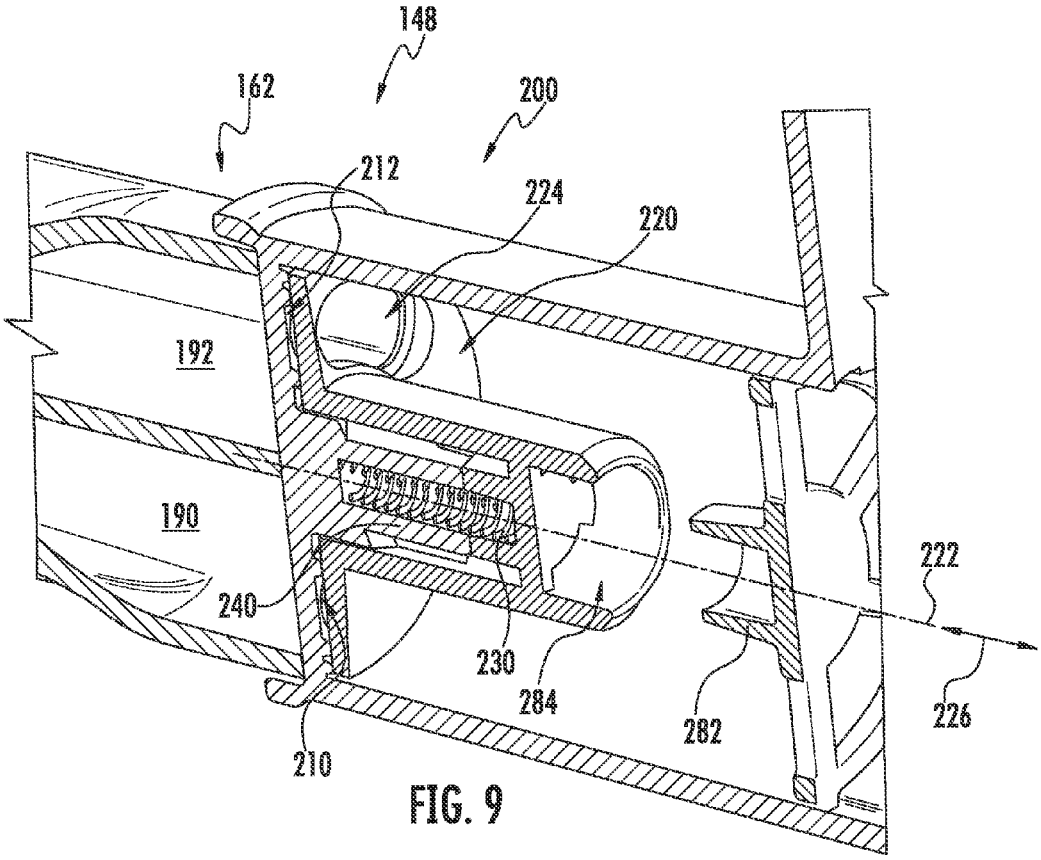
FIG. 9 is a cross-sectional view of an exemplary passive diverter in a conduit of an exemplary embodiment of mid-level spray arm assembly of the present disclosure with an internal disk shown in a second position.
Figure 10:
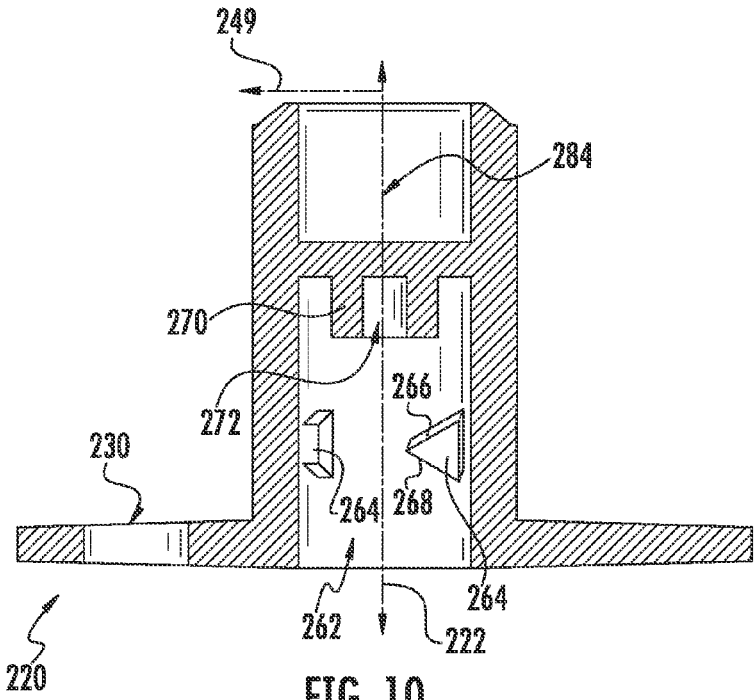
FIG. 10 is a cross-sectional view of an exemplary embodiment of a rotating disk of the present disclosure.

Movement of disk 220 back and forth between the first position shown in FIG. 7 and the second position shown in FIG. 9 is provided by two opposing forces: i) the fluid flow passing through diverter 200 that is counteracted by ii) a biasing element 230, such as a compression spring as shown. More particularly, biasing element 230 in exemplary embodiments urges the disk 220 into the first position. For example, when fluid is not flowing through diverter 200, biasing element 230 pushes along axial direction 226 against disk 220 and forces it away from the ports 210, 212, 214 along axis 222 to the position shown in FIG. 7. Conversely, when there is a sufficient flow of fluid through diverter chamber 204, the momentum of this fluid will impact disk 220. This momentum overcomes the force provided by biasing element 230 so as to shift disk 220 along axial direction 226 towards the ports 210, 212, 214 to a second position such as that shown in FIG. 9. Disk 220 will remain in the second position until the fluid flow ends or drops below a certain level. Then, biasing element 230 urges disk 220 along axial direction 226 back into the first position shown in FIG. 7.

The movement of disk 220 back and forth along axis 222 between the first and second positions shown in FIGS. 7 through 9 also causes disk 220 to rotate about axis 222 so that aperture 224 is switched between the various ports 210, 212, 214. For this exemplary embodiment, a single movement in either direction causes disk 220 to rotate approximately 60 degrees. Accordingly, disk 220 rotates about axis 222 approximately 120 degrees each time it is moved out of, and then returned to, either the first position (FIG. 7) or the second position (FIG. 9).

Figure 6:
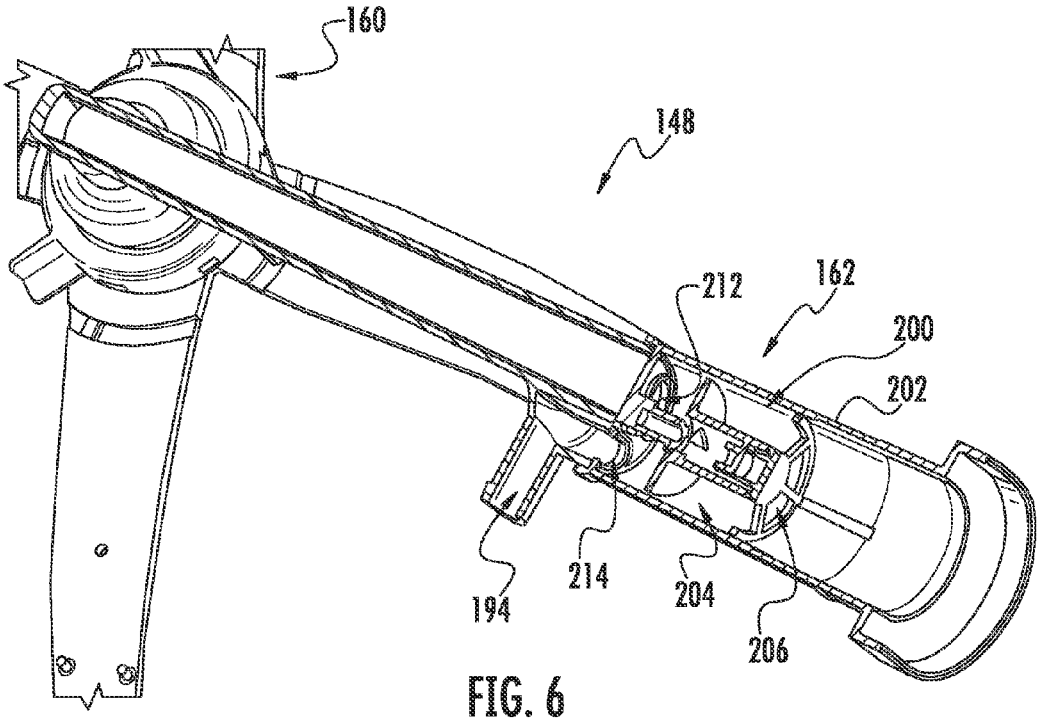
FIG. 6 is a cross-sectional view of various internal components of a conduit of an exemplary embodiment of mid-level spray arm assembly of the present disclosure.
Figure 11:
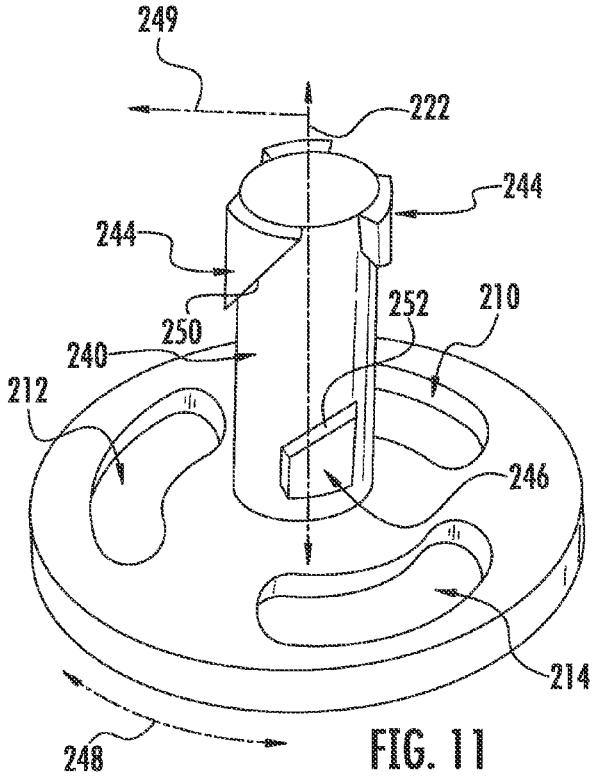
FIG. 11 is a perspective view of an exemplary boss and outlet ports of the present disclosure.

As shown in FIGS. 6, through 9 and 11, for this exemplary embodiment, outlet ports 210, 212, 214 are spaced apart along a circumferential direction at angles of approximately 120 degrees. Thus, the rotation of disk 220 by approximately 120 degrees necessarily rotates aperture 224 so as to selectively provide fluid flow from one outlet port to the next outlet port along the direction of rotation.

As further illustrated, a cylindrically-shaped boss 240 extends along axis 222 from housing 202 into the chamber 204. As shown, when in the second position, the boss 240 may extend into a channel 262 defined by disk 220. Boss 240 may further define a recess 242 into which a first end of biasing element 230 is received. Boss 240 may also include a plurality of guide elements 244, 246 that are spaced apart from each other along a circumferential direction 248. The guide elements 244, 246 may project from the boss 240, such as in a radial direction 249. A first plurality of guide elements 244 are located near a distal end of boss 240 while a second plurality of guide elements 246 are located near the outlet ports 210, 212, 214. Guide elements 244 and 246 are spaced apart along axial direction 226 and are also offset from each other along circumferential direction 248. More particularly, each of the second plurality of guide elements 246 is aligned with a gap positioned between a respective pair of the first plurality of guide elements 244. Conversely, each of the first plurality of guide elements 244 is aligned with a gap between a respective pair of the second plurality of guide elements 246.

Each of the guide elements 244 and 246 includes a contact face 250 and 252, respectively. Each face 250 and 252 may be at, for example, a non-zero angle between zero and 90 degrees from the axial direction 226. For the exemplary embodiment shown, this angle is about 45 degrees. In another embodiment, this angle is about 42 degrees. In still another embodiment, this angle is between about 40 degrees to about 50 degrees from the axial direction 226. It should be understood, however, that the present disclosure is not limited to the above disclosed angles, and rather that any suitable angles or combination of angles is within the scope and spirit of the present disclosure.

As stated and shown, boss 240 is received into a channel 262 formed and defined by disk 220. Disk 220 may further include a plurality of cams 264 projecting along the radial direction 249 into channel 262. Each cam 264 includes an upper contact face 266 and a lower contact face 268. Each face 266 and 268 may, similar to contact faces 250, 252, be at, for example, a non-zero angle between zero and 90 degrees from the axial direction 226. A pin 270 of disk 220 extending into channel 262 may form and define a second recess 272 into which a second end of biasing element 230 is received.

Guide elements 244, 246 and cams 264 are configured to interact so that movement of the disk 220 along the axial direction 226 between the first position and the second position causes the disk 220 to rotate about the axis 222. Thus, for example, as a flow of fluid overcomes biasing element 230 and disk 220 moves from the first position towards the second position, lower contact face 268 of each cam 264 contacts contact face 252 of a guide element 246. Disk 220 is caused to rotate, such as approximately 60 degrees, so that each cam 264 moves into a gap between a pair of the plurality of guide elements 246. This movement is guided by contact face 268 and contact face 252. In this second position, aperture 224 is aligned with one of the outlet ports 210, 212, 214. As the flow of fluid is turned off, biasing element 230 causes disk 220 to move towards the first position. During this movement, upper contact face 266 of each cam 264 contacts contact face 250 of a guide element 244 and causes disk 220 to rotate another approximately 60 degrees so that each cam 264 moves into a gap between a pair of the first plurality of guide elements 244. This movement is guided by contact face 266 and contact face 250. Upon returning to the second position, disk 220 is again caused to rotate by approximately 60 degrees as previously described so that aperture 230 is now switched to the next outlet port. The process can be repeated to switch to still another outlet port.

In some embodiments, a backing plate 280 may be included in housing 202. Backing plate 280 may generally define the fluid inlet 206 to the chamber 204 of diverter 200, and may further restrain movement of the disk 220. Thus, for example, the first position of the disk 220 may be maintain when there is no fluid flow due to interaction between the disk 220 and plate 280. Plate 280 may include a protrusion 282 which contacts a depression 284 defined in the disk 220 to restrain the disk 220 as required. Further, plate 280 may include openings 286 to allow fluid to flow therethrough.

Accordingly, during operation of appliance 100, controller 137 can be programmed to operate pump 154 to flow fluid into the mid-level spray arm assembly 148 and thus control the position of disk 220. For example, knowing the last outlet port through which fluid flow occurred, controller 137 can activate pump 154 to rotate disk 220 to the next outlet port in the direction of rotation of disk 220 so as to control the flow of fluid. Each time pump 154 is cycled off and back on to provide a flow of fluid through passive diverter 200, the controller 137 will "know" that disk 220 has been rotated to the next outlet port.

As stated, the passive diverter of the present invention may be used with more or less than three outlet ports. In such case, as will be understood by one of skill in the art using the teachings disclosed herein, the configuration of cams and guide elements described above can be modified to provide the desired amount of rotation between the selected number of outlet ports. Three cams along with three upper and four lower guide elements are used to provide approximately 120 degrees of rotation between three outlet ports in the exemplary embodiment above described. By way of example, four cams along with four upper and four lower guide elements could be used to provide approximately 90 degrees of rotation between four outlet ports and so forth.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance, comprising:

a tub that defines a wash chamber for receipt of articles for washing;

a mid-level spray arm assembly for directing a fluid flow into the wash chamber, the mid-level spray arm assembly comprising a spray arm and a conduit in fluid communication with the spray arm, the conduit defining a plurality of outlet channels for providing the fluid flow to the wash chamber;

a diverter disposed in the conduit and defining an axial direction, the diverter comprising a housing defining a chamber, the chamber having a fluid inlet and at least one outlet port to supply fluid to the outlet channels;

a disk positioned within the chamber and rotatable about an axis, the disk defining an aperture for selectively controlling fluid flow from the chamber into one of the outlet channels, the disk movable along the axial direction between a first position and a second position, the disk defining a channel and a plurality of cams projecting into the channel;

a biasing element configured to urge the disk into the first position; and a boss extending from the housing into the channel of the disk, the boss defining a plurality of guide elements, wherein the disk is movable along and separate from the boss along the axial direction between the first position and the second position, and wherein the guide elements and cams are configured to interact so that movement of the disk along the axial direction between the first position and the second position causes the disk to rotate about the axis.

2. The dishwasher appliance of claim 1, wherein the disk and biasing element are configured so that the rotatable disk is moved into the second position by fluid flow through the chamber.

3. The dishwasher appliance of claim 1, wherein the chamber has a plurality of outlet ports, each of the outlet ports in fluid communication with one of the plurality of outlet channels.

4. The dishwasher appliance of claim 1, wherein the boss defines a first recess into which a first end of the biasing element is received.

5. The dishwasher appliance of claim 1, wherein the disk defines a second recess within the channel, and wherein a second end of the biasing element is received into the second recess.

6. The dishwasher appliance of claim 1, wherein the boss is cylindrically-shaped and defines a circumferential direction and a radial direction, wherein the guide elements of the boss project along the radial direction and are spaced apart from each other along the circumferential direction.

7. The dishwasher appliance of claim 6, Wherein the guide elements each include a contact face positioned at a non-zero angle from the axial direction.

8. The dishwasher appliance of claim 1, wherein the housing is a portion of the conduit upstream of the plurality of outlet channels.

9. The dishwasher appliance of claim 1, wherein the plurality of outlet channels comprises a primary channel and a reverse channel.

10. The dishwasher appliance of claim 1, wherein the plurality of outlet channels further comprises a bottle blaster channel.

11. A mid-level spray arm assembly for a dishwasher appliance, comprising:

a spray arm;

a conduit in fluid communication with the spray arm, the conduit defining a plurality of outlet channels;

a diverter disposed in the conduit and defining an axial direction, the diverter comprising a housing defining a chamber, the chamber having a fluid inlet and at least one outlet port to supply fluid to the outlet channels;

a disk positioned within the chamber and rotatable about an axis, the disk defining an aperture for selectively controlling fluid flow from the chamber into one of the outlet channels, the disk movable along the axial direction between a first position and a second position, the disk defining a channel and a plurality of cams projecting into the channel;

a biasing element configured to urge the disk into the first position; and a boss extending from the housing into the channel of the disk, the boss defining a plurality of guide elements, wherein the disk is movable along and separate from the boss along the axial direction between the first position and the second position, and wherein the guide elements and cams are configured to interact so that movement of the disk along the axial direction between the first position and the second position causes the disk to rotate about the axis.

12. The mid-level spray arm assembly of claim 11, wherein the disk and biasing element are configured so that the rotatable disk is moved into the second position by fluid flow through the chamber.

13. The mid-level spray arm assembly of claim 11, wherein the chamber has a plurality of outlet ports, each of the outlet ports in fluid communication with one of the plurality of outlet channels.

14. The mid-level spray arm assembly of claim 11, wherein the boss defines a first recess into which a first end of the biasing element is received.

15. The mid-level spray arm assembly of claim 11, wherein the disk defines a second recess within the channel, and wherein a second end of the biasing element is received into the second recess.

16. The mid-level spray arm assembly of claim 11, wherein the boss is cylindrically-shaped and defines a circumferential direction and a radial direction, wherein the guide elements of the boss project along the radial direction and are spaced apart from each other along the circumferential direction.

17. The mid-level spray arm assembly of claim 16, wherein the guide elements each include at a contact face positioned at a non-zero angle from the axial direction.

18. The mid-level spray arm assembly of claim 11, wherein the housing is a portion of the conduit upstream of the plurality of outlet channels.

19. The mid-level spray arm assembly of claim 11, wherein the plurality of outlet channels comprises a primary channel and a reverse channel.

20. The mid-level spray arm assembly of claim 11, wherein the plurality of outlet channels further comprises a bottle blaster channel.

* * * * *